US010249464B2

(12) United States Patent
Hiremath et al.

(10) Patent No.: US 10,249,464 B2
(45) **Date of Patent: *Apr. 2, 2019**

(54) MODULAR CIRCUIT BREAKER AND METHOD OF ASSEMBLING

(71) Applicant: EATON CORPORATION, Cleveland, OH (US)

(72) Inventors: Somashekharayya Hiremath, Coraopolis, PA (US); Sandy Omar Jimenez, Monaca, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 385 days.

This patent is subject to a terminal disclaimer.

(21) Appl. No.: 15/160,081

(22) Filed: May 20, 2016

(65) Prior Publication Data

US 2017/0338072 A1 Nov. 23, 2017

(51) Int. Cl.

| | |
|---|---|
| ***H01H 47/00*** | (2006.01) |
| ***H01H 71/24*** | (2006.01) |
| ***H01H 47/22*** | (2006.01) |
| ***H01H 69/00*** | (2006.01) |
| ***H01H 71/02*** | (2006.01) |
| ***H01H 71/08*** | (2006.01) |
| ***H01H 11/00*** | (2006.01) |
| *H01H 83/14* | (2006.01) |
| *H01H 83/20* | (2006.01) |

(52) U.S. Cl.

CPC ..... *H01H 71/24* (2013.01); *H01H 11/0031* (2013.01); *H01H 47/22* (2013.01); *H01H 69/00* (2013.01); *H01H 71/025* (2013.01); *H01H 71/08* (2013.01); *H01H 11/0006* (2013.01); *H01H 2011/0037* (2013.01); *H01H 2083/148* (2013.01); *H01H 2083/201* (2013.01)

(58) Field of Classification Search

CPC ..... H01H 71/24

See application file for complete search history.

(56) References Cited

U.S. PATENT DOCUMENTS 4,833,563 A * 5/1989 Russell ..... H01H 71/0228 361/115

4,945,450 A * 7/1990 Sabatella ..... H02B 1/056 361/609

(Continued)

*Primary Examiner* — Stephen W Jackson

(74) *Attorney, Agent, or Firm* — Eckert Seamans

(57) ABSTRACT

A modular circuit breaker includes a module assembly coupled to a primary assembly. The primary assembly includes a primary housing, separable contacts disposed therein, a first terminal conductor electrically connected to one of the separable contacts, a conductive tab electrically connected to another one of the separable contacts and which extends outward from a first end of the primary housing, an operating mechanism disposed in the primary housing for selectively opening and closing the separable contacts, and a trip mechanism disposed in the primary housing cooperative with the operating mechanism to trip open the separable contacts. The module assembly includes a module housing having a second terminal conductor positioned therein and electrically connected to the conductive tab, a third terminal conductor structured to be electrically connected to a neutral conductor of a load, and a fourth terminal conductor structured to be coupled to a neutral bus.

19 Claims, 14 Drawing Sheets

(56) References Cited

U.S. PATENT DOCUMENTS

| | | | | |
|---|---|---|---|---|
| 6,879,228 | B2 | 4/2005 | Lias et al. | |
| 9,614,356 | B2 * | 4/2017 | Natili | H02B 1/0565 |
| 10,032,590 | B2 * | 7/2018 | Hiremath | H01F 38/20 |

* cited by examiner

MODULAR CIRCUIT BREAKER AND METHOD OF ASSEMBLING

BACKGROUND

Field

The disclosed concept relates generally to circuit breakers and, more particularly, to primary assemblies and module assemblies for use in modular circuit breakers. The disclosed concept also relates to method of assembling a modular circuit breaker.

Background Information

Circuit breakers are used to protect electrical circuitry from damage due to an overcurrent condition, such as an overload condition or a relatively high level short circuit or fault condition. In small circuit breakers, commonly referred to as miniature circuit breakers such as those typically used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens separable contacts of the circuit breaker to interrupt current flow in the protected power system.

One type of such circuit breaker is an arc fault circuit interrupter which is intended to mitigate the effects of arc faults by functioning to de-energize an electrical circuit when an arc fault is detected.

Another type of such circuit breaker is a ground fault circuit interrupter which is intended to mitigate the effects of ground faults by functioning to de-energize an electrical circuit when a ground fault is detected.

Yet another type of such circuit breaker is a dual purpose arc fault/ground fault circuit interrupter which is intended to mitigate the effects of both arc faults and/or ground faults by functioning to de-energize an electrical circuit when either an arc fault or a ground fault is detected.

Presently, each of such different types of circuit breakers utilize generally unique housings. The variations in housings and components among such different types of breakers serves an encumbrance to the implementation of technological improvements as typically specialized components must be designed and constructed for use in each type of circuit breaker.

There is, therefore, a need for an improved circuit breaker arrangement which may be utilized for various types of circuit breakers.

There is also a need for improved methods of assembling such various types of circuit breakers.

SUMMARY

These needs and others are met by embodiments of the disclosed concept, which as one aspect provides a primary assembly for use with a module assembly in a modular circuit breaker. The primary assembly comprises: a primary housing having a first end structured to engage the module assembly; a pair of separable contacts disposed in the primary housing; a first terminal conductor disposed in or on the primary housing and structured to engage a line terminal, the first terminal conductor being electrically connected to one of the separable contacts; a conductive tab electrically connected to another one of the separable contacts, the conductive tab extending outward from the first end of the primary housing; an operating mechanism disposed in the primary housing for selectively opening and closing the separable contacts; and a trip mechanism disposed in the primary housing cooperative with the operating mechanism to trip open the separable contacts.

The primary assembly may further comprise a control unit electrically connected to a solenoid, wherein the solenoid is structured to mechanically engage the operating mechanism upon receiving an electronic signal from the control unit, and wherein the control unit is electrically connected to a number of electrical connectors disposed at or about the first end of the primary housing.

The primary assembly may further comprise a test module disposed on or in the primary housing and electrically connected to the control unit, the test module having a manual actuator which is positioned and structured to be manipulated by a user.

The primary housing may comprise: a base member having a generally planar outer wall and a number of side walls which extend generally perpendicular to, and away from the outer wall; a middle base member having a generally planar middle wall and a number of side walls which extend generally perpendicular to, and away from the middle wall; a top cover including a generally planar outer wall; and a number of fasteners coupling the base member, middle base member and top cover together.

The outer wall and the number of side walls of the base member and the middle wall of middle base member may define an operating mechanism cavity having the operating mechanism disposed therein; and the middle wall and the number of side walls of the middle base member and the planar outer wall of the top cover may define a PCB cavity in which a PCB assembly is disposed.

The PCB assembly may comprise: a control unit electrically connected to a solenoid, wherein the solenoid is structured to mechanically engage the operating mechanism upon receiving an electronic signal from the control unit, and a test module disposed on or in the primary housing and electrically connected to the control unit, the test module having a manual actuator which is positioned and structured to be manipulated by a user, wherein the control unit is electrically connected to a number of electrical connectors disposed at or about the first end of the primary housing.

As another aspect of the disclosed concept module assembly for use with a primary assembly in a modular circuit breaker comprises: a module housing having a first end structured to be engaged by the primary assembly; a second terminal conductor which is positioned within the module housing and structured to be electrically connected to a power conductor of a load; a third terminal conductor which is positioned within the module housing and structured to be electrically connected to a neutral conductor of a load; and a fourth terminal conductor which is positioned and structured to be coupled to a neutral bus.

The module housing may comprise: a module base portion; a module middle base portion; and a module top cover.

The module base member and the module middle base member may define a second terminal cavity therebetween in which the second terminal conductor is disposed and the module middle base member and the module top cover may define a third terminal cavity therebetween in which the third terminal conductor is disposed.

The module base portion and the module middle portion may be formed as a single continuous member.

The module middle base portion and the module top cover may be formed as a single continuous member.

The module base portion, the module middle portion, and the module top cover may all be formed as a single continuous member.

The module assembly may further comprise a module PCB and a current transformer electrically connected to the module PCB, wherein the module PCB is electrically connected to at least one of a number of module electrical connectors disposed at or about the first end of the module housing, and wherein each of the third terminal conductor and the fourth terminal conductor are electrically connected to at least one of the number of module electrical connectors.

The fourth terminal conductor may comprise a bolt on neutral connector.

The fourth terminal conductor may comprise a plug on neutral connector.

As yet another aspect of the disclosed concept, a modular circuit breaker comprises a module assembly as described herein coupled to a primary assembly as described herein.

The module housing of the module assembly may be rotatably coupled to the primary housing of the primary assembly.

As a further aspect of the disclosed concept a method of assembling a modular circuit breaker comprises providing a primary assembly as described herein and coupling a module assembly as described herein to the primary assembly.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "coupled" together shall mean that the parts are joined together either directly or joined through one or more intermediate parts. Further, as employed herein, the statement that two or more parts are "attached" shall mean that the parts are joined together directly.

As employed herein, the term "number" shall be used to refer to an non-zero quantity, i.e., one or more.

As described in greater detail herein, the disclosed concept provides a circuit breaker arrangement and method of assembling which addresses shortcoming in conventional designs. More specifically, the disclosed concept provides for a "modular" arrangement which optimizes the use of common components while providing the addition and/or removal of components which may be unique to a particular application. The disclosed concept also provides for an assembly method which improves upon conventional methods.

Figure 1:
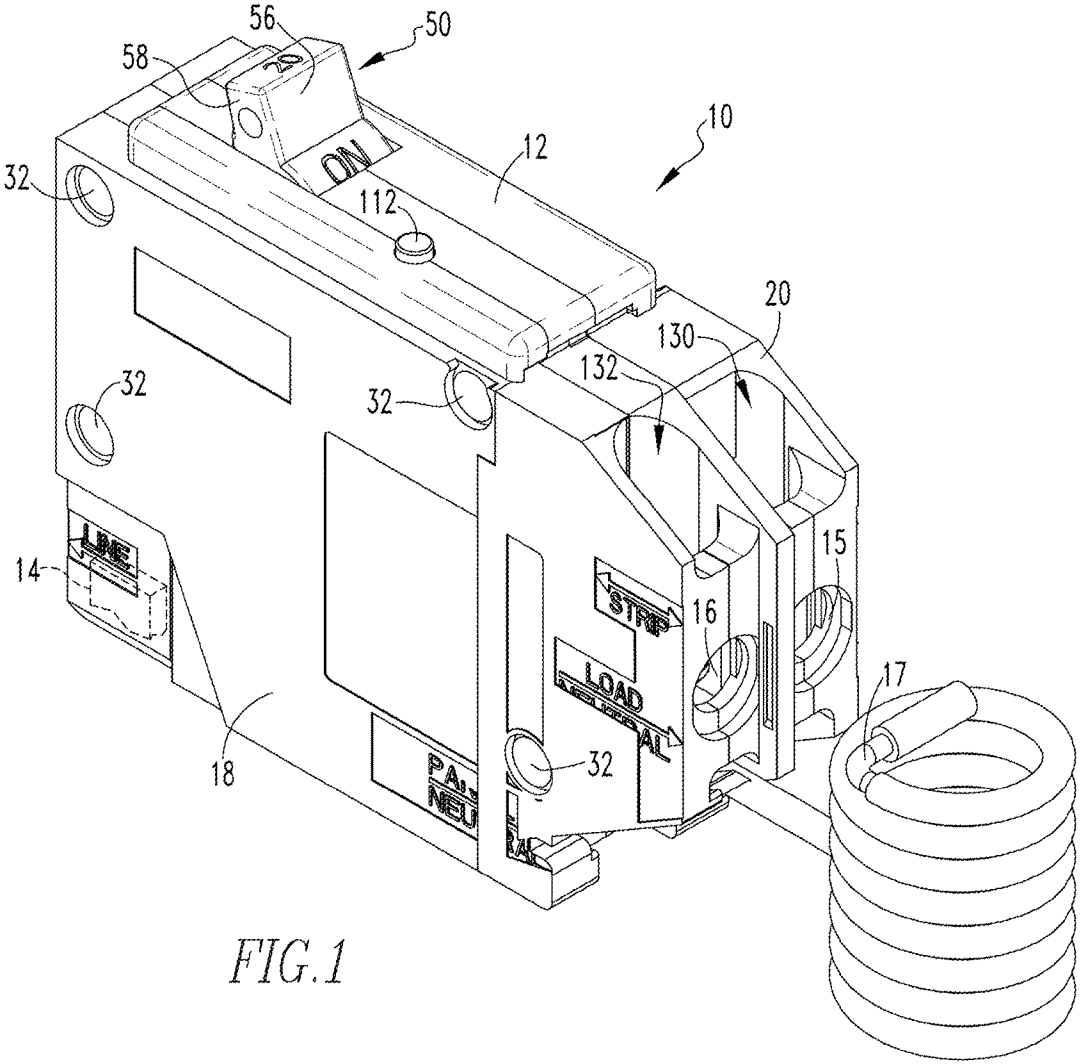
FIG. 1 is an isometric view of a modular circuit breaker in accordance with an example embodiment of the disclosed concept.

As shown in FIG. 1, an electronic circuit breaker 10 of generally modular design in accordance with the disclosed concept includes a non-conductive housing 12, a first terminal conductor 14, a second terminal conductor 15, a third terminal conductor 16, a fourth terminal conductor 17, and an operating mechanism assembly 50. As with a conventional circuit breaker, first terminal conductor 14 is positioned and structured to be electrically connected to a line terminal in an electrical distribution panel. Second terminal conductor 15 is positioned and structured to be electrically connected to a load power conductor in an electrical distribution panel. Third terminal conductor 16 is positioned and structured to be electrically connected to a neutral conductor associated with a load in an electrical distribution panel. Fourth terminal conductor 17 is structured to be electrically connected to a neutral bus in an electrical distribution panel. Although fourth terminal conductor 17 is shown as a "pigtail" type connector, it is to be appreciated that fourth terminal conductor may also be formed as other connection mechanisms, as will be described elsewhere herein, without varying from the scope of the disclosed concept.

Figure 2:
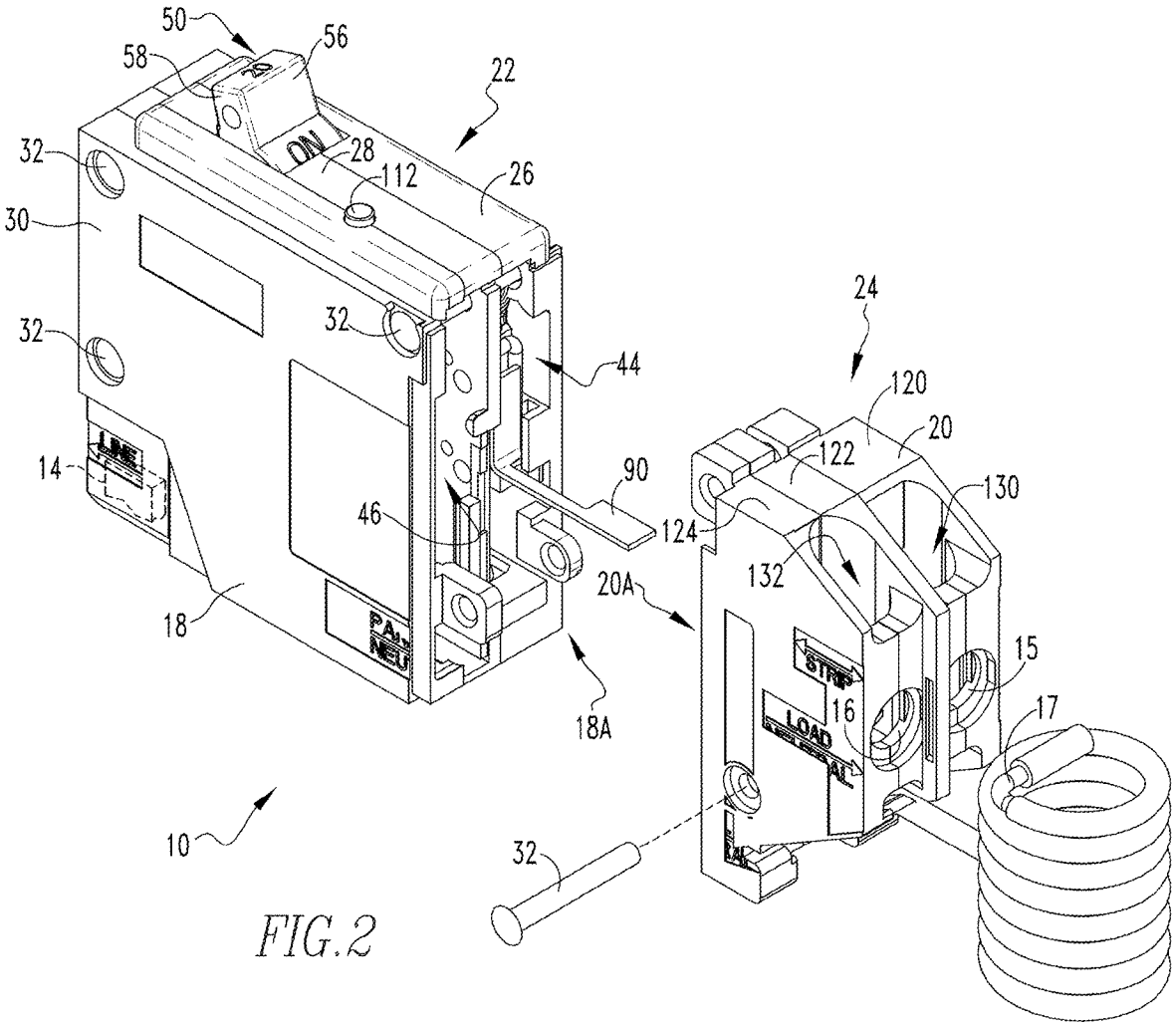
FIG. 2 is a partially exploded isometric view of the modular circuit breaker of FIG. 1 showing the module portion separated from the primary portion.

Continuing to refer to FIG. 1, as well as to FIG. 2, housing 12 includes a non-conductive primary housing 18 and a separately formed non-conductive module housing 20. Such housings 18, 20 may be formed from one or more plastics, thermosets, thermoplastics, or any other suitable non-conductive materials without varying from the scope of the disclosed concept. Primary housing 18 generally delineates and encloses a primary assembly 22 of circuit breaker 10. Module housing 20 generally delineates and encloses a separate module assembly 24 of modular circuit breaker 10. Referring to FIG. 2, primary housing 18 includes a first end 18A which generally engages a corresponding end 20A of module housing 20 when primary housing 18 and module housing 20 are coupled together to form modular circuit breaker 10. Accordingly, it is to be appreciated that primary portion 22 and module portion 24 are each sub-portions of modular circuit breaker 10 which are pre-fabricated as separate units 18, 20 and then coupled together at a later time to form modular circuit breaker 10, as will be discussed in greater detail below.

Figure 3:
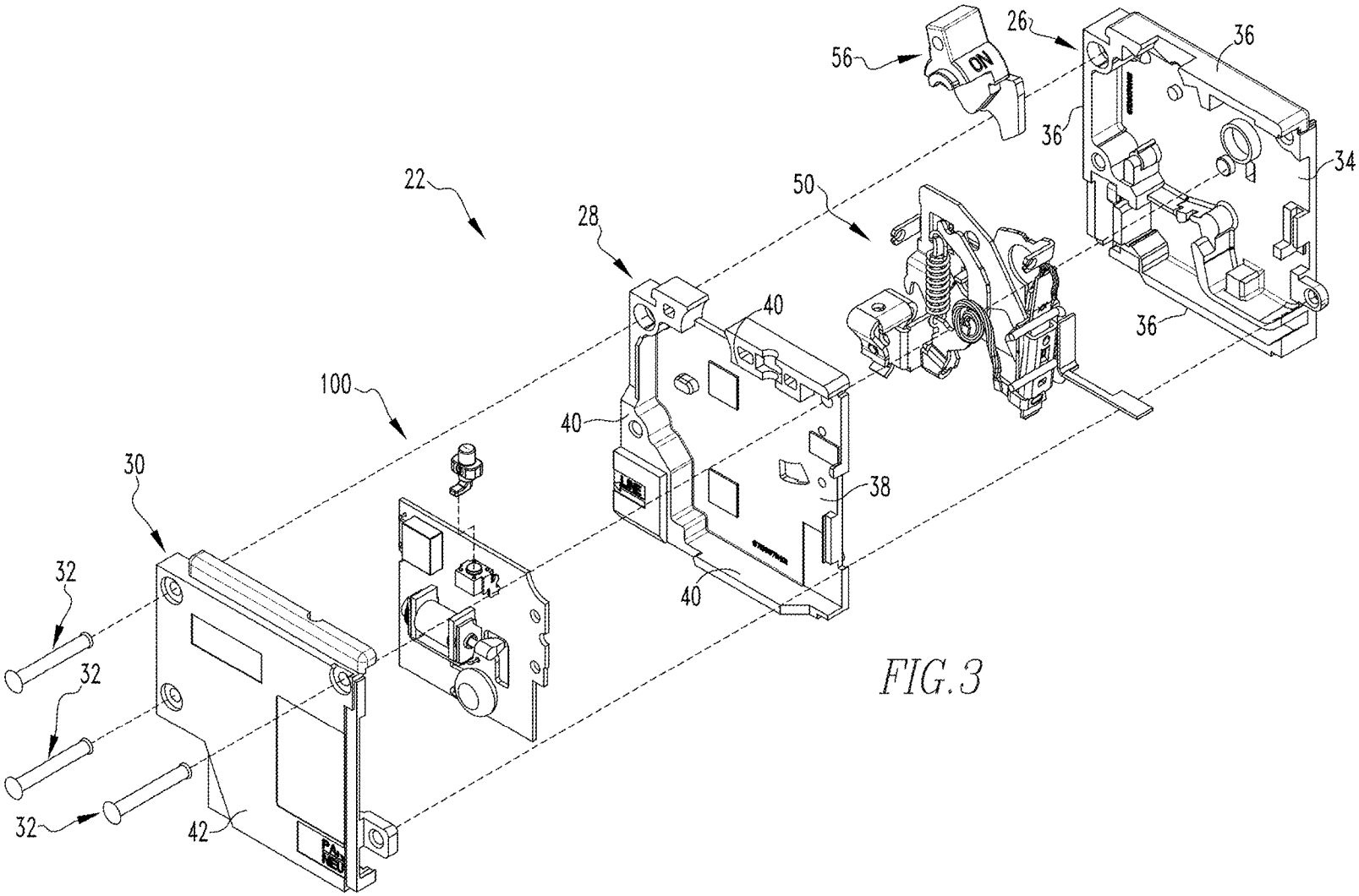
FIG. 3 is a partially exploded isometric view of the primary portion of FIG. 2.

Referring now to FIGS. 2-5, primary housing 18 includes a base member 26, a middle base member 28, and a top cover 30 which are formed as separate members and then subsequently coupled together in a layered fashion via a number of suitable fasteners 32 during manufacturing. In the illustrated example embodiment, a number of rivets are employed as fasteners 32, it is to be appreciated, however, that other suitable fasteners may be employed without varying from the scope of the disclosed concept. Referring to FIG. 3, base member 26 includes a generally planar outer wall 34 and a number of side walls 36 which extend generally perpendicular to, and away from, outer wall 34. Middle base member 28 includes a generally planar middle wall 38 and a number of side walls 40 which extend generally perpendicular to, and away from, middle wall 38. Top cover 30 includes a generally planar outer wall 42.

Referring to the assembled view of FIG. 2, when middle base member 28 and base member 26 are coupled together, an operating mechanism cavity 42, generally bounded by outer wall 34 and side walls 36 of base member 26 as well as by middle wall 38 of middle base member 28, is formed. Also, when middle base member 28 and top cover 30 are coupled together, a PCB cavity 46, generally bounded by middle wall 38 and side walls 40 of middle base member 28 as well as by planar outer wall 42 of top cover 30, is formed.

Figure 4:
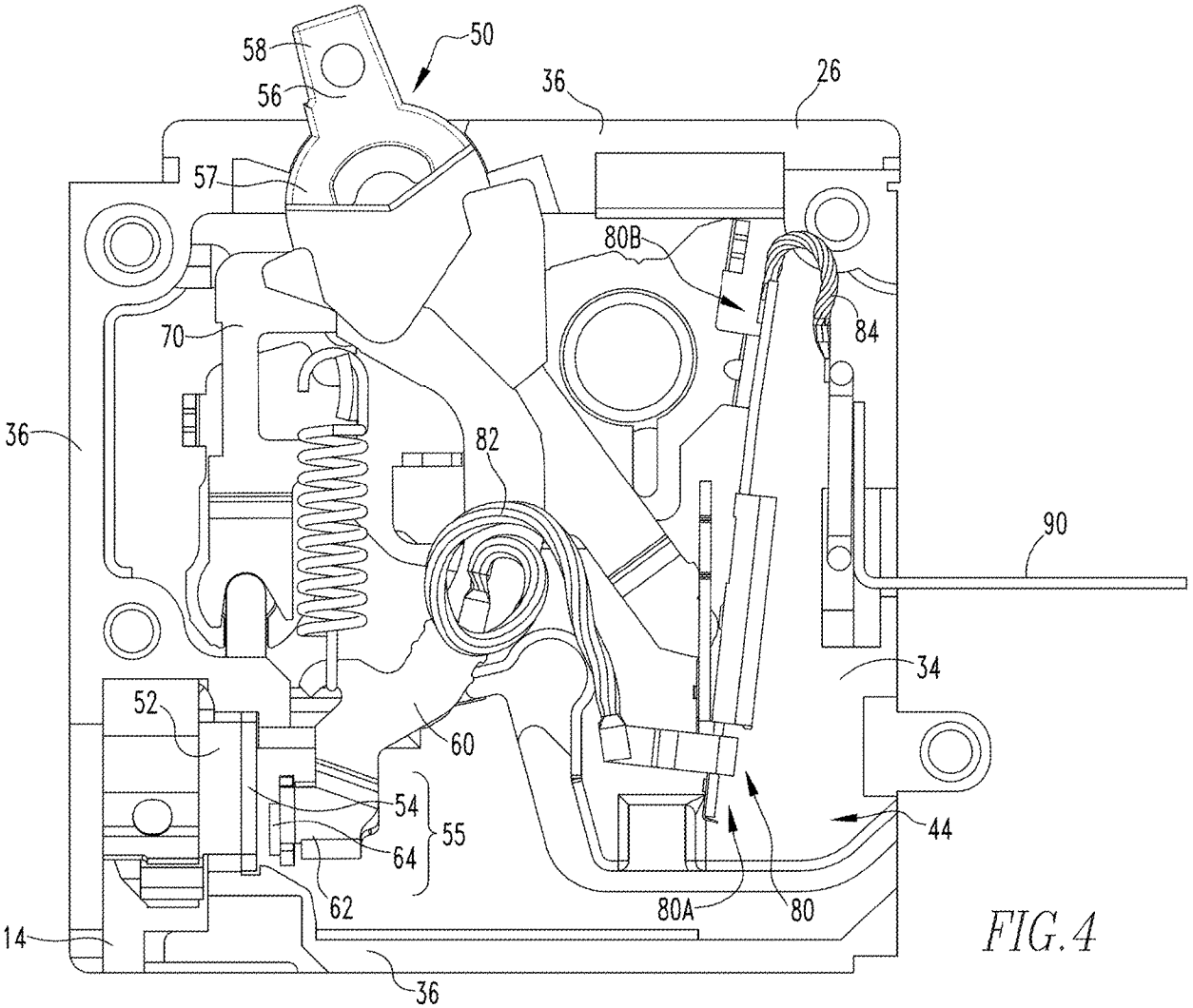
FIG. 4 is an elevation side view of a partially assembled primary portion of FIG. 2 showing an operating mechanism and base member thereof.
Figure 5:
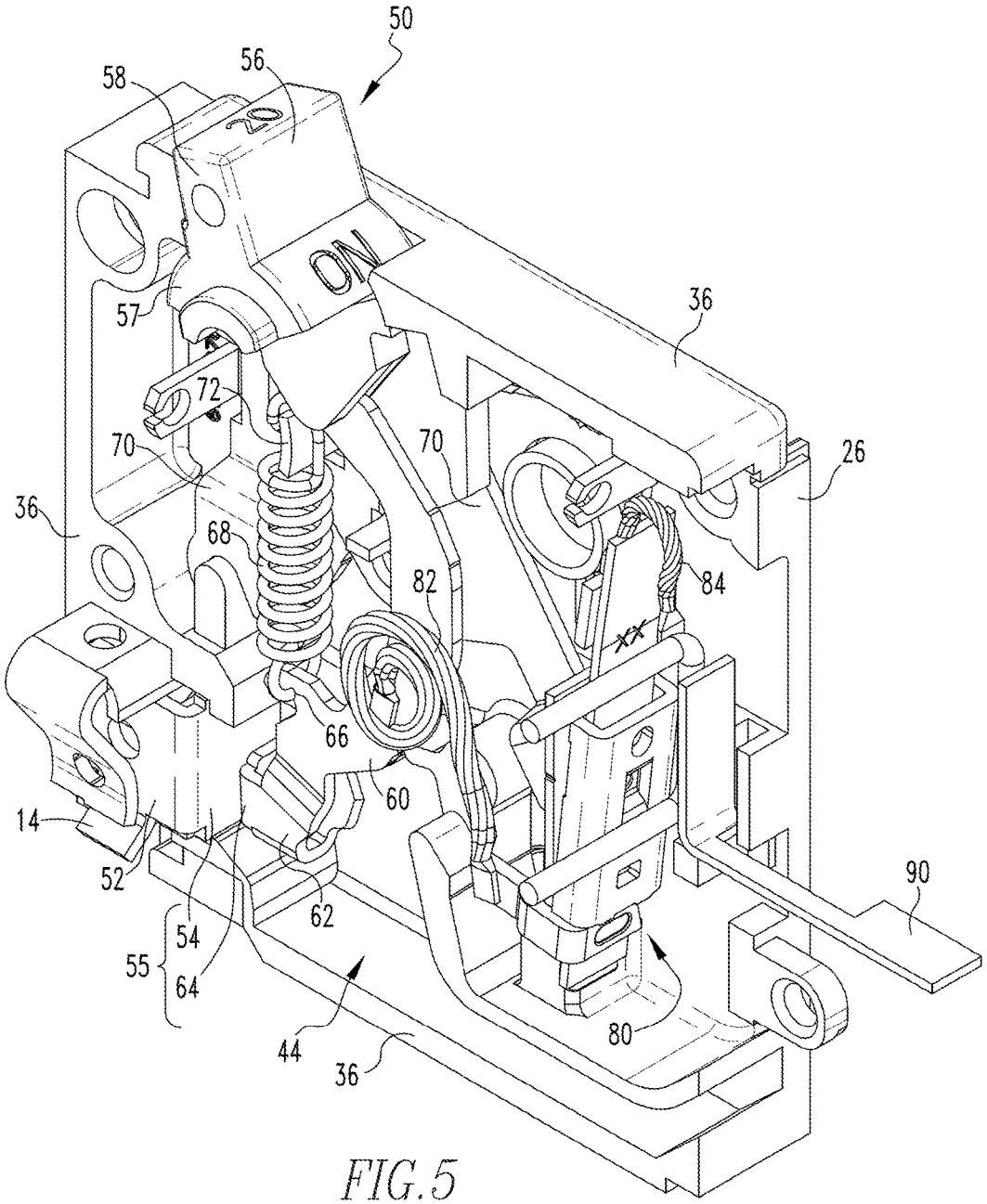
FIG. 5 is an isometric view of the partially assembled primary portion of FIG. 4.

Referring now to the partially assembled view of primary portion 22 shown in FIGS. 4 and 5, first terminal conductor 14 is mounted generally in side walls 36 of base member 26 of primary housing 18 at a location external to the operating mechanism cavity 44. First terminal conductor 14 includes a conductive tab 52 that extends through side walls 36 into operating mechanism cavity 44. First terminal conductive tab 52 terminates in a fixed contact 54 of a pair of separable contacts 55. Accordingly, first terminal conductor 14 is electrically connected to fixed contact 54.

Continuing to refer to FIGS. 4 and 5, an example operating mechanism 50 is shown disposed on base member 26 generally in operating mechanism cavity 44. It is to be appreciated that operating mechanism 50 is shown in detail for example purposes only and that other operating mechanisms may be employed without varying from the scope of the disclosed concept. Operating mechanism 50 generally includes a handle member 56, an operating arm 60, a frame assembly 70, and a trip device 80. Handle member 56 is made from a non-conductive material and includes a generally circular portion 57 which rests against, and rotates about a portion of frame assembly 70, and an elongated, radial extension 58 that extends out of the primary housing 18 in a manner which may be readily engaged by a human operator of circuit breaker 10. The operating arm 60 includes a contact end 62 that forms a movable contact 64 of separable contacts 55, a handle member engaging end disposed generally opposite contact end 62 and a spring tab 66. Spring tab 66 is engaged by a spring 68 which extends therefrom to a protrusion 72 of frame assembly 70 and thus biases movable contact 64 toward fixed contact 54. Operating arm 60 is moveable between a first position in which separable contacts 55 are disposed in a closed position, such as shown in FIGS. 4 and 5, and a second position in which separable contacts 55 are disposed in an open position. Movement of operating arm 60 between such positions is accomplished via movement of handle member 56 between "On" and "Off" positions as is common practice.

Operating arm 60 is preferably made from a conductive metal, such as copper or brass and is electrically connected to a line side conductor 80A of trip device 80 via a flexible conductor 82. Trip device 80 is of known construction and may function generally as described in U.S. Pat. No. 6,879,228, the contents of which are incorporated by reference herein, to cause operating mechanism 50 to move to a tripped position in response to an overcurrent condition. Other suitable arrangement of trip device 80 may also be employed without varying from the scope of the disclosed concept. A load side conductor 80B of trip device 80 is electrically connected via another flexible conductor 84 to a conductive tab 90 which extends outward from first end 18A of primary housing 18. Conductive tab 90 may be formed from copper, brass, or other suitable material. It is to be appreciated that through such arrangement of operating arm 60, flexible conductor 82, trip device 80, and flexible conductor 84, conductive tab 90 is thus electrically connected to movable contact 64.

Figure 6:
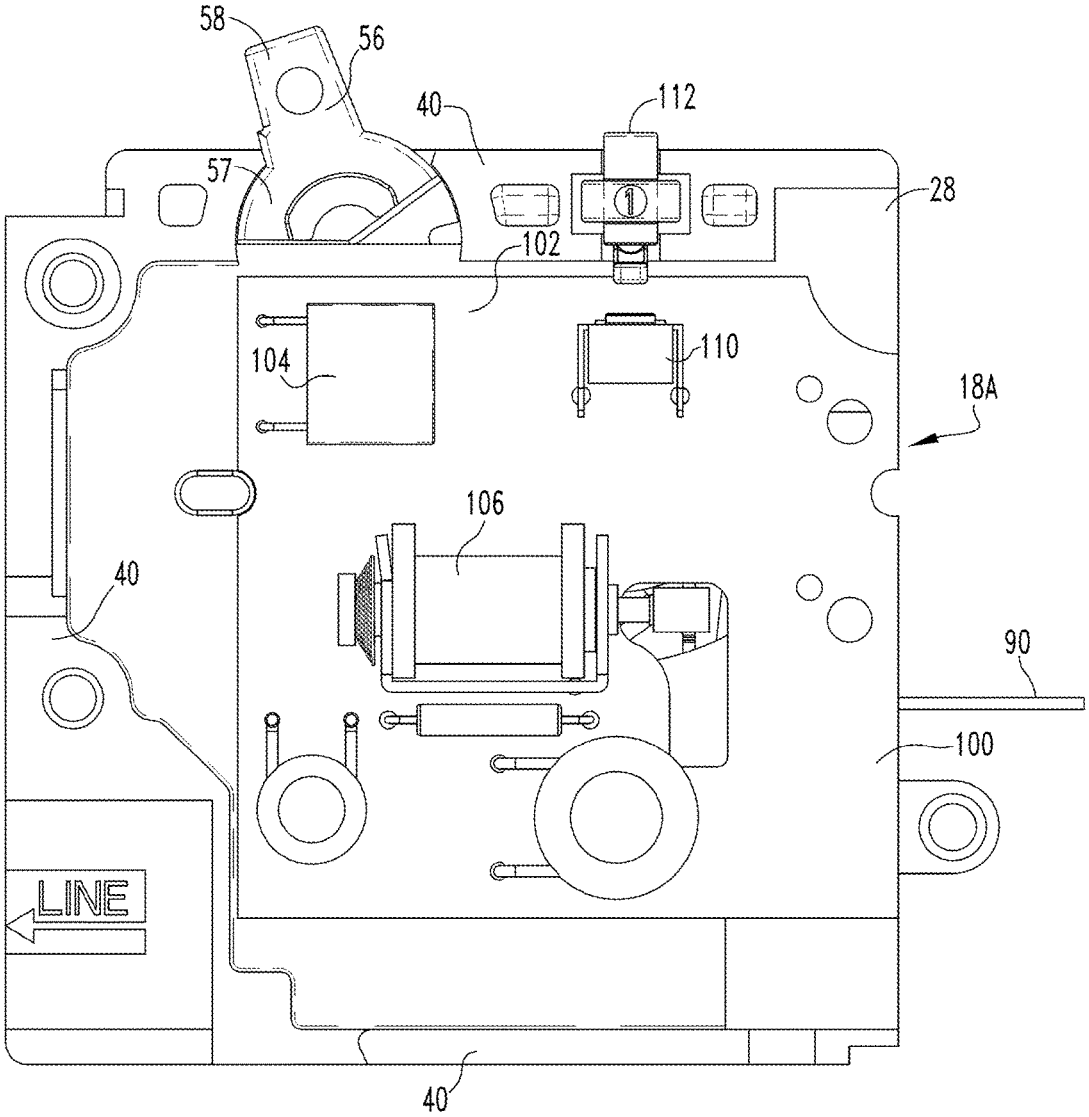
FIG. 6 is an elevation side view of a further partially assembled primary portion of FIG. 2 showing an PCB assembly and a middle base member thereof.

FIG. 6 shows a further assembled side elevation view of primary portion 22. More particularly, FIG. 6 shows a similar view as FIG. 4 with the addition of middle base member 28 and a PCB assembly 100 which is disposed within PCB cavity 46. In other words, FIG. 6 shows a side elevation view of primary portion 22 with top cover 30 removed. PCB assembly 100 includes a printed circuit board 102 of conventional design having a control unit 104 disposed thereon. In the exemplary embodiment, control unit 104 comprises a processor portion and may include a memory portion, and may be, for example and without limitation, a microcontroller or a microprocessor or other suitable processing device. Control unit 104 is electrically connected to a number of primary electrical connectors 106 disposed at or about first end 18A of primary housing 18.

Figure 7:
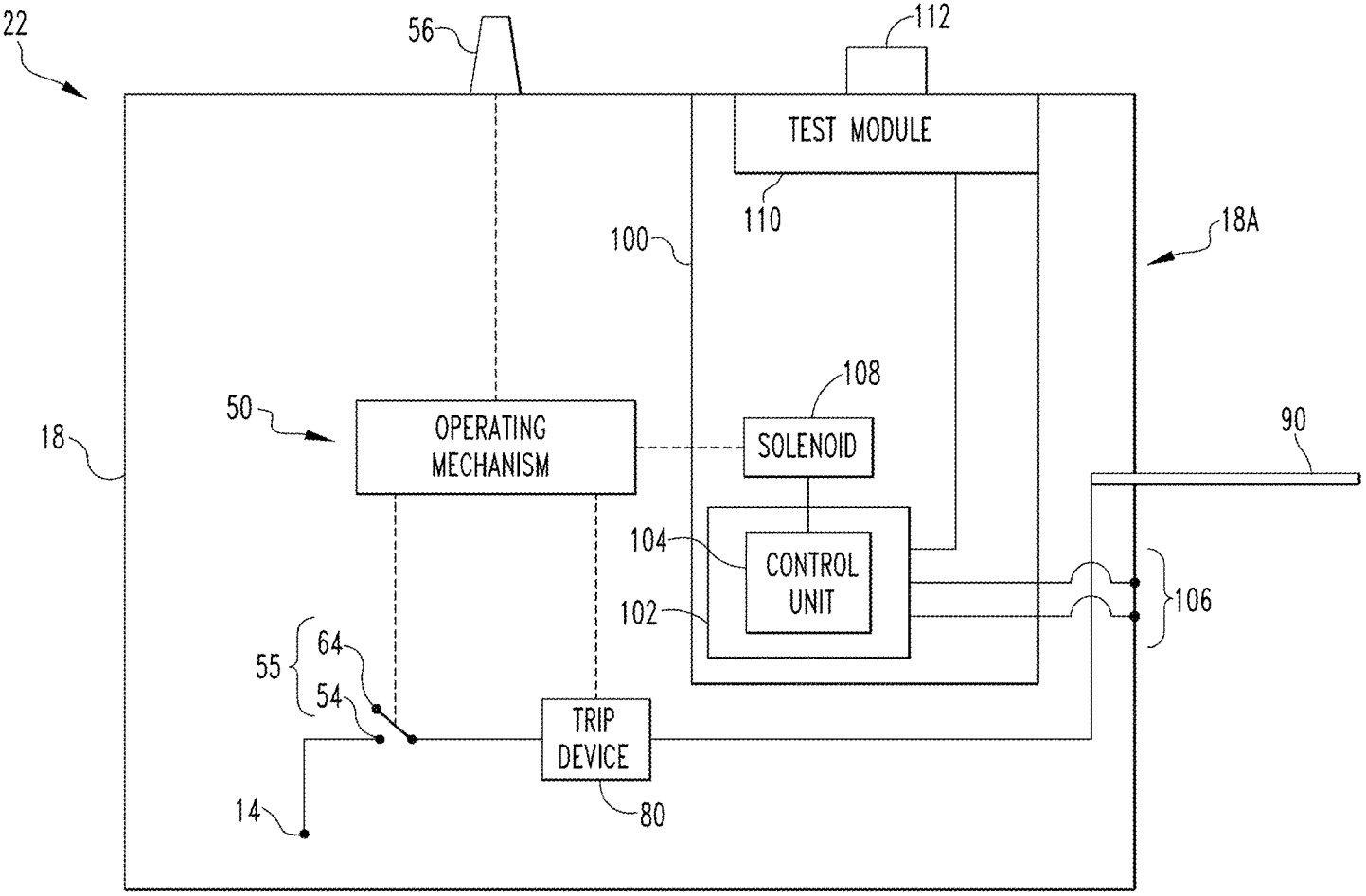
FIG. 7 is a schematic diagram showing the basic components of the primary portion of FIG. 2.

Continuing to refer to FIG. 6, as well as to the schematic view of FIG. 7, PCB assembly 100 further includes a solenoid 108 and a test module 110 which are both electrically connected to control unit 104. Solenoid 108 is positioned and structured to mechanically interact with operating mechanism 50 such that when a signal is received from control unit 104, solenoid 108 acts to cause operating mechanism 50 to move to a tripped position. Test module 110 includes a manual actuator 112 which is positioned with respect to primary housing 18 to be actuated by a user for testing operation of the control unit 104 and solenoid 108 in successfully tripping operating mechanism 50.

Figure 8:
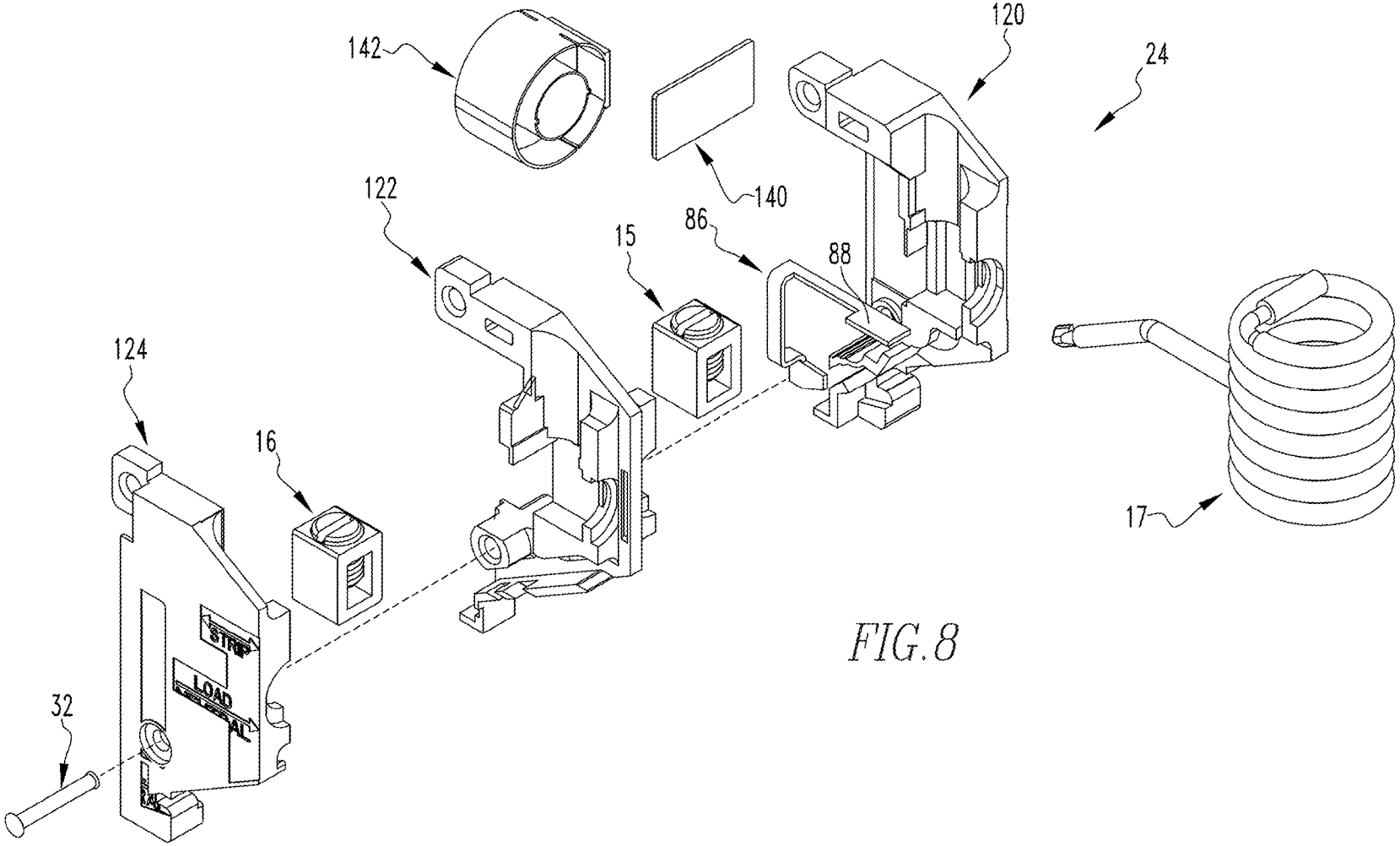
FIG. 8 is an exploded isometric view of the module portion of FIG. 2.

Having thus described the general arrangement of example primary portion 22, the general arrangement of an example module portion 24 which may be coupled to primary portion 22 will now be described in conjunction with FIGS. 8-10. As shown in FIG. 8, module housing 20 includes a module base member 120, a module middle base member 122 which engages module base member 120, and a module top cover 124 which engages module middle base member 122 generally opposite module base member 120. Module base member 120, module middle base member 122, and a module top cover 124 may be coupled together via one or more suitable fasteners 32 during manufacturing. In the example embodiment, a single rivet is employed as fastener 32. When module middle base member 122 is engaged with module base member 120, such as shown in FIG. 2, a second terminal cavity 130 is defined therebetween in which second terminal conductor 15 is disposed. As shown schematically in FIG. 9, second terminal conductor 15 is positioned within second terminal cavity 130 such that second terminal conductor 15 is electrically engaged by conductive tab 90, thus completing the electrical pathway from an AC voltage source, through modular circuit breaker 10, to a load. Similar to the formation of second terminal cavity 130, when module top cover 124 is engaged with module middle base member 122, a third terminal cavity 132 is defined therebetween in which third terminal conductor 16 is disposed. Each of second terminal conductor 15 and third terminal conductor 16 may be inserted into second terminal cavity 130 and third terminal cavity 132, respectively, either from the top of cavities 130 and 132, or alternatively inward from side 20A of module housing 20. As shown in the exploded view of FIG. 8, module portion 24 may include a neutral conductor in the form of a multi-angled member 86 which includes a first end 88 which is structured to directly engage third terminal conductor 16, and another end which is electrically connected to fourth terminal conductor 17. In other example embodiments, discussed further below, the other end of multi-angled member 86 may be directly formed as a fourth terminal conductor.

Although shown as being formed from three discrete members 120, 122, 124 in the illustrated example embodiment, in another example embodiment of the disclosed concept module base member 120 and module middle base member 122 are formed as a single integral member. In yet another example embodiment, module middle base member 122 and module top cover 124 are integrally formed as a single member. In yet a further example embodiment, module base member 120, module middle base member 122, and module top cover 124 are integrally formed as a single member.

Figure 9:
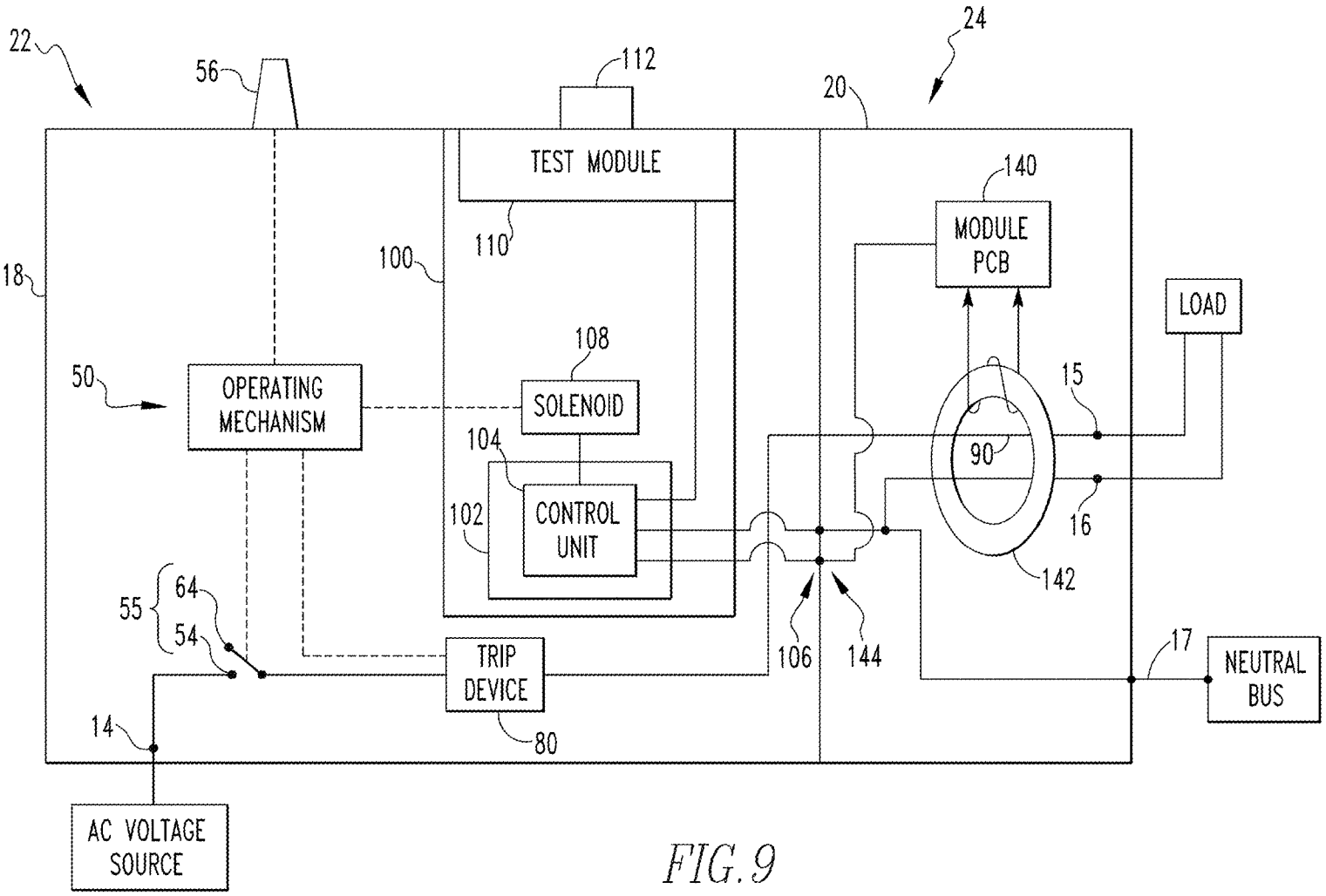
FIG. 9 is a schematic diagram showing the general components of the modular circuit breaker of FIG. 1 electrically connected to a voltage source, a load, and a neutral bus.

Continuing to refer to FIG. 8, as well as to the schematic view of FIG. 9, module portion 24 may, depending on the desired application, include a module PCB 140 and a current transformer 142 electrically connected to module PCB 140. Module PCB is electrically connected to at least one of a number of module electrical connectors 144 disposed at or about first end 20A of module housing 20. Each of the third terminal conductor 16 and the fourth terminal conductor 17 are also electrically connected to at least one of the number of module electrical connectors 144. As shown schematically in FIG. 9, the number of module electrical connectors 144 are positioned and structured to be electrically connected to the number of primary electrical connectors 106 when module portion 24 is coupled to primary portion 22. Continuing to refer to the schematic view of FIG. 9, current transformer 142 is positioned and structured to detect the flow of current passing through at least second terminal conductor 15 and electrically communicate such detections to module PCB 140. Module PCB 140 then electrically communicates such detections to control unit 104 via the number of module electrical connectors 144 and the number of primary electrical connectors 106.

Figure 10:
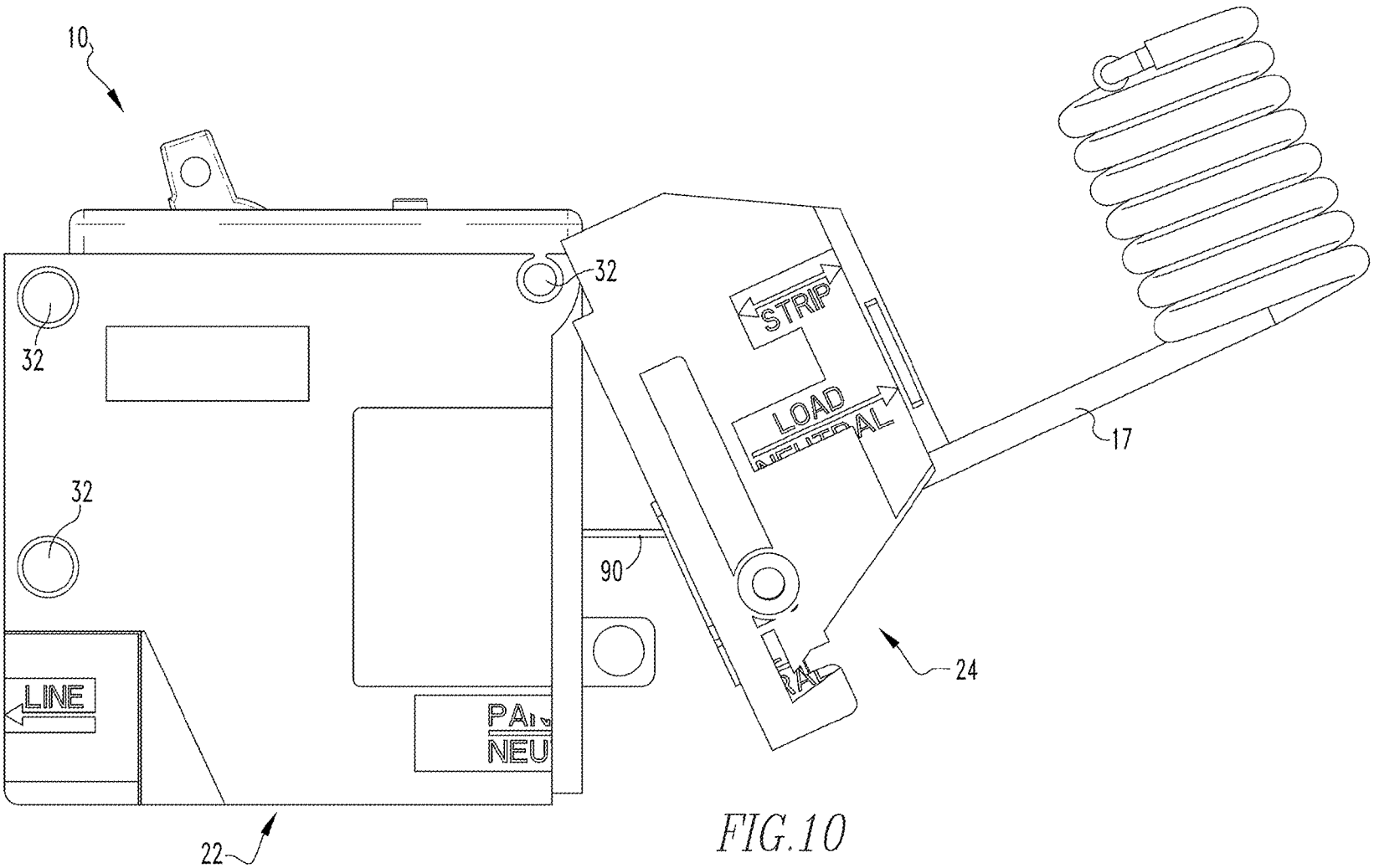
FIG. 10 is a side view of a modular circuit breaker having a module portion rotatably coupled thereto in accordance with an example embodiment of the disclosed concept.

Referring now to FIG. 10, a side view of modular circuit breaker 10 having module portion 24 rotatably coupled to primary portion 22 via a single fastener 32 in accordance with an example embodiment of the disclosed concept is shown. It is to be appreciated that such arrangement generally provides for internal components of to be added to, or removed from one or both of primary portion 22 and module portion 24 during manufacturing in order to meet particular requirements. For example, without limitation, multi-angled member 86 of FIG. 8 could instead be readily substituted by one of the fourth terminal arrangements discussed below to readily create a circuit breaker for a particular application.

Figure 11:
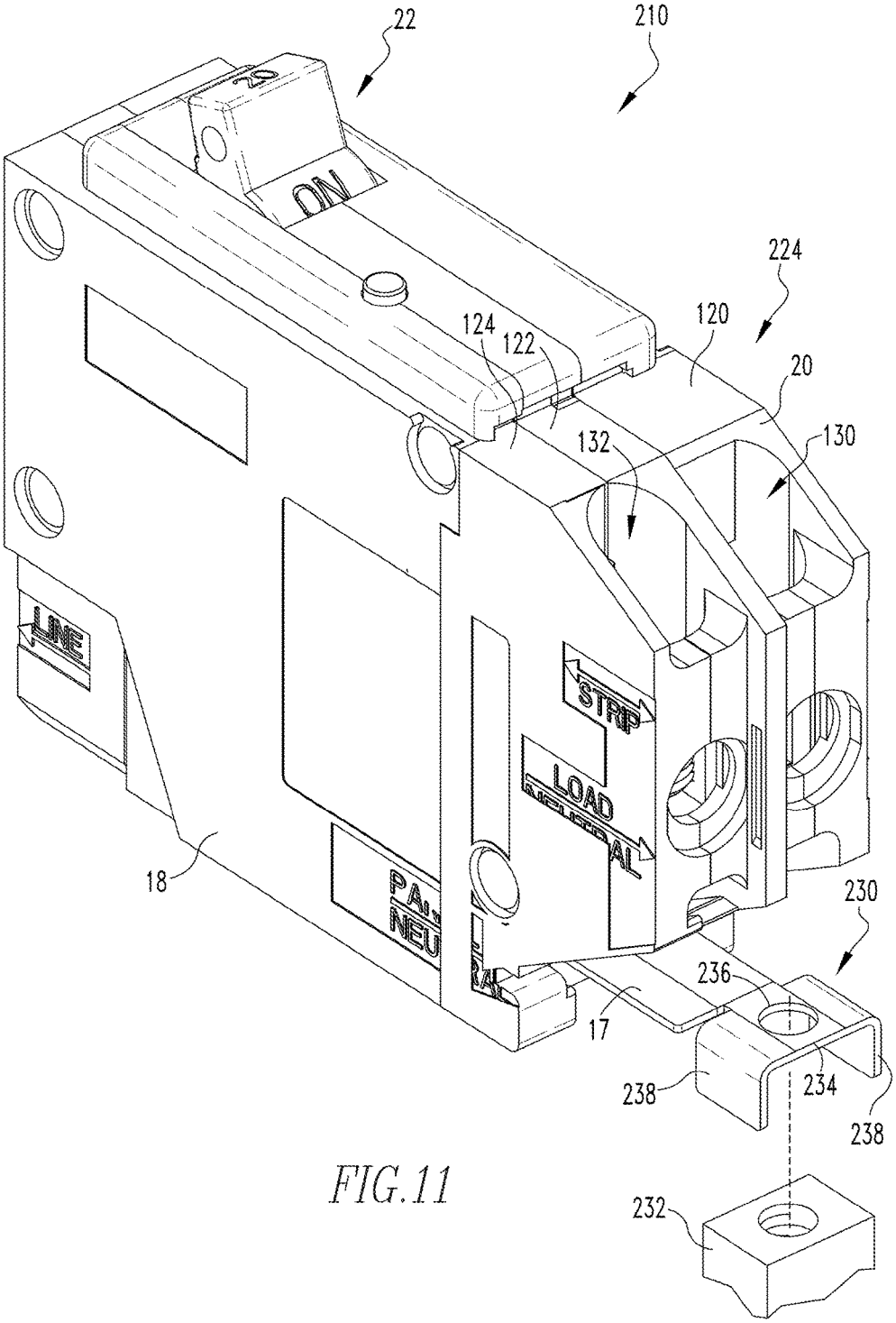
FIG. 11 is an isometric view of a modular circuit breaker having a bolt on neutral connection in accordance with an example embodiment of the disclosed concept.

FIG. 11 shows an isometric view of a modular circuit breaker 210 having a fourth terminal conductor 17 of a module assembly 224 formed as a bolt on neutral connector 230 in accordance with an example embodiment of the disclosed concept. Bolt on neutral connector 230 may be formed from any suitable conductive material and is structured to be rigidly coupled to a neutral bus 232 such as via a bolt or other suitable fastener. Bolt on neutral connector 230 includes a generally planar, central portion 234 which may include an aperture 236 formed therethrough for allowing passage of a suitable fastener. Bolt on neutral connector 230 further includes a number of downward extending portions 238 which extend from central portion 234. Each of downward extending portions 238 are positioned and structured to generally engage a corresponding surface of neutral bus 232 so as to provide a large surface contact area.

Figure 12:
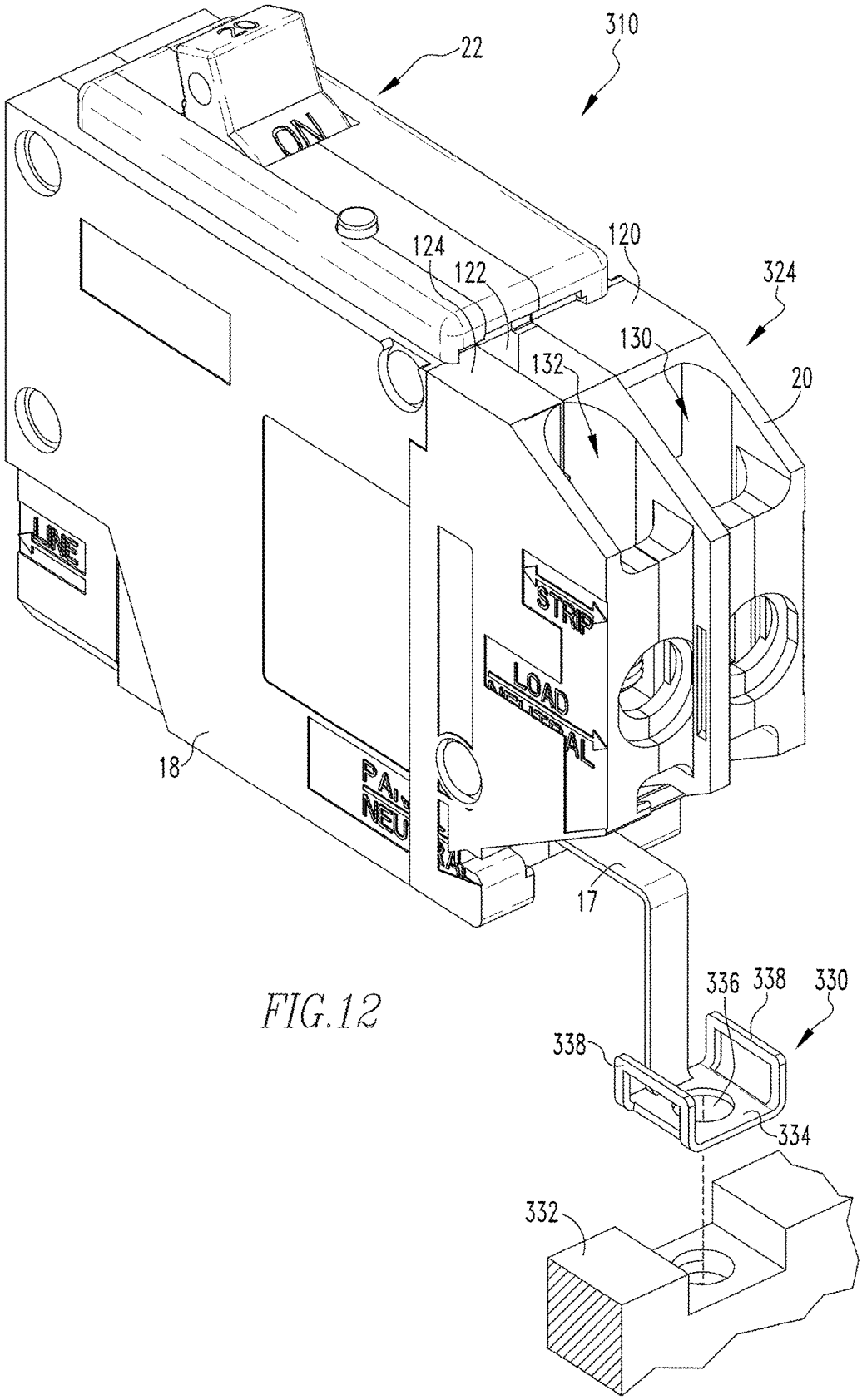
FIG. 12 is an isometric view of a modular circuit breaker having a bolt on neutral connection in accordance with another example embodiment of the disclosed concept.

FIG. 12 shows an isometric view of a modular circuit breaker 310 having a fourth terminal conductor 17 of a module assembly 324 formed as a bolt on neutral connector 330 in accordance with another example embodiment of the disclosed concept. Bolt on neutral connector 330 may be formed from any suitable conductive material and is structured to be rigidly coupled to a neutral bus 332 such as via a bolt or other suitable fastener. Bolt on neutral connector 330 includes a generally planar, central portion 334 which may include an aperture 336 formed therethrough for allowing passage of a suitable fastener. Bolt on neutral connector 330 further includes a number of upward extending portions 338 which extend upward central portion 334. Each of upward extending portions 338 are positioned and structured to generally engage a corresponding surface of neutral bus 332 so as to provide a large surface contact area.

Figure 13:
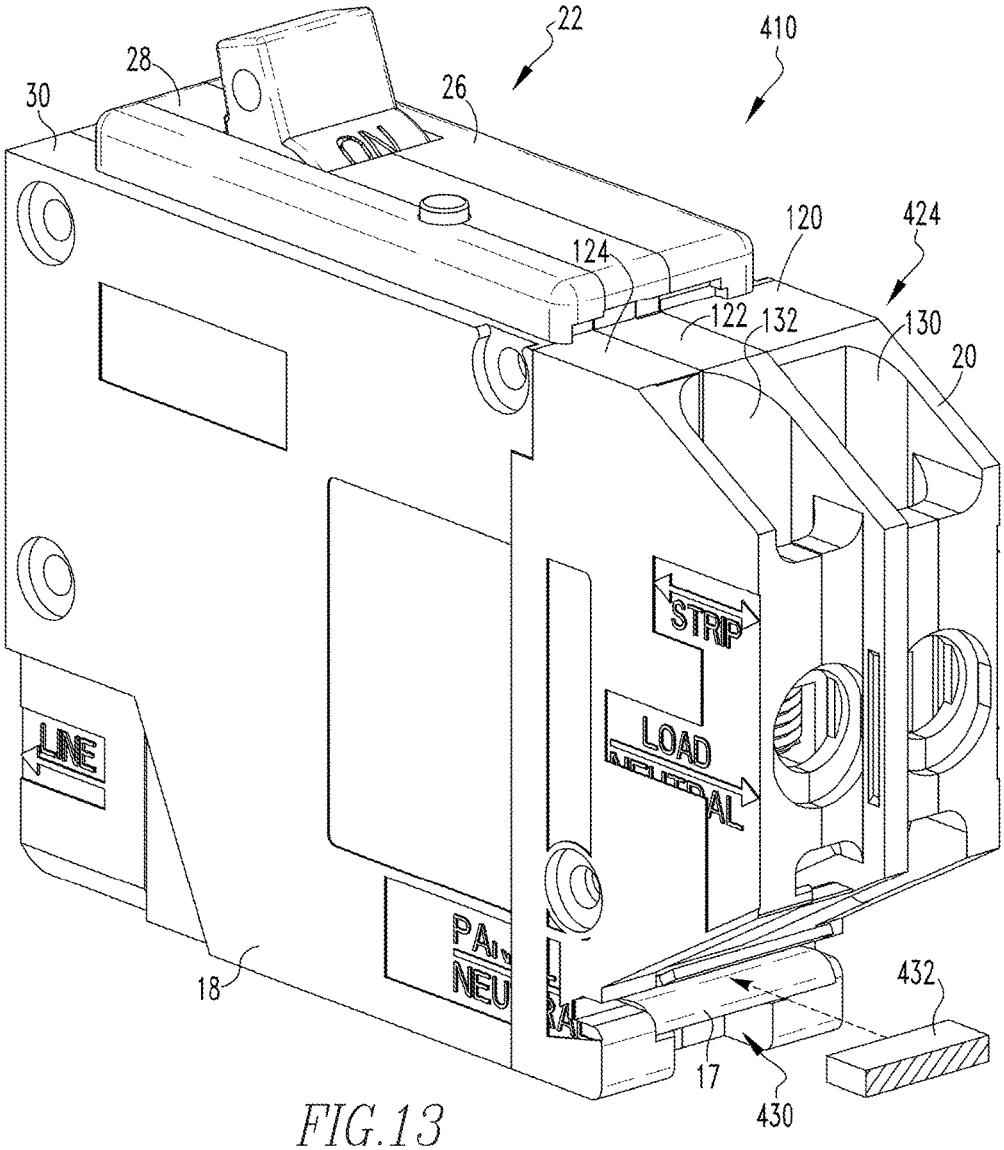
FIG. 13 is an isometric view of a modular circuit breaker having a plug on neutral connection in accordance with an example embodiment of the disclosed concept.
Figure 14:
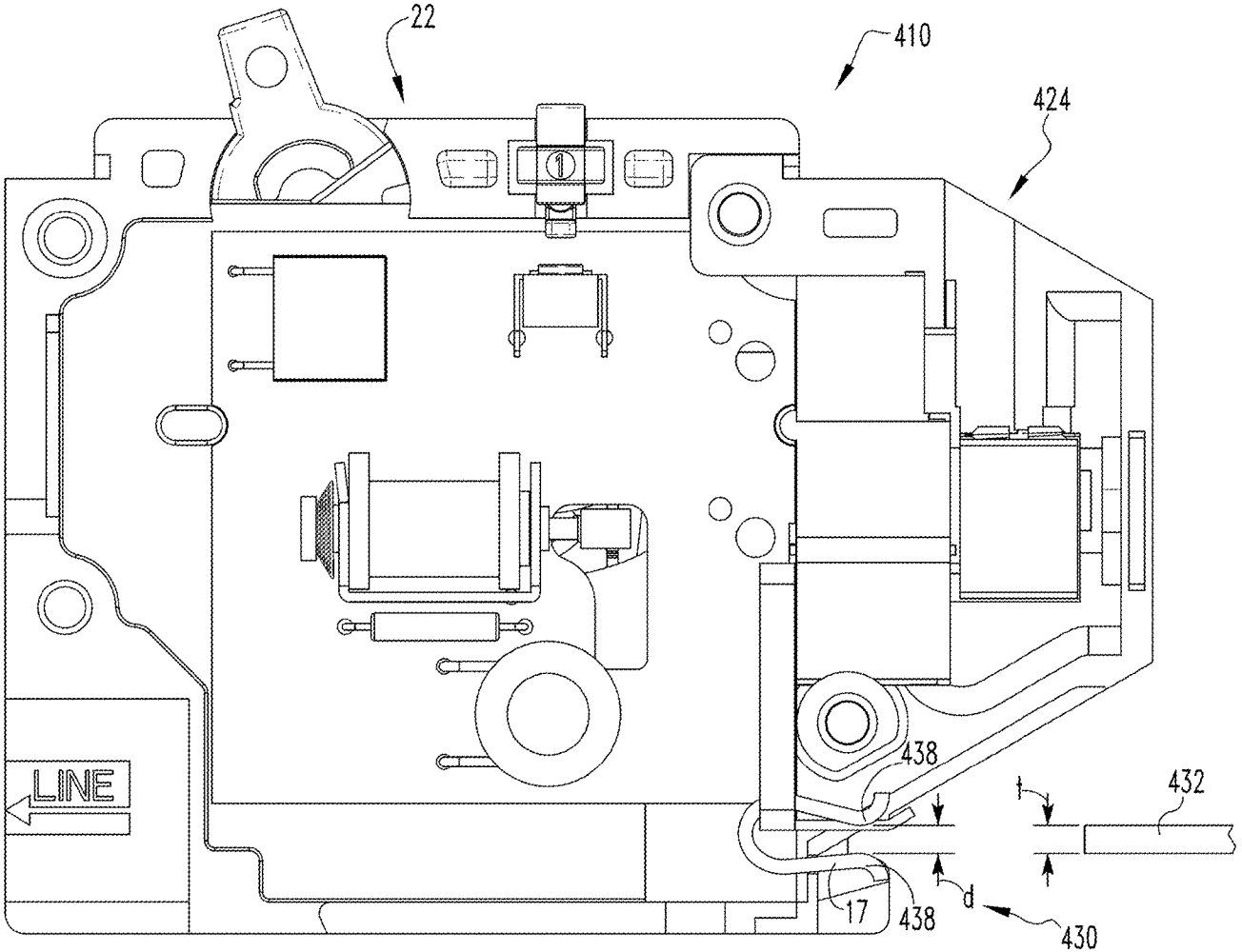
FIG. 14 is a side view of the modular circuit breaker of FIG. 13 shown with top cover portions removed to show internal details.

FIG. 13 is an isometric view of a modular circuit breaker 410 having a fourth terminal conductor 17 of a module assembly 424 formed as a plug on neutral connector 430 in accordance with an example embodiment of the disclosed concept. Plug on neutral connector 430 may be formed from any suitable conductive material and is structured to be engaged to a neutral bus 432, generally without the need of any fasteners. Referring to FIG. 14, which shows modular circuit breaker 410 with outer portions 30 and 124 removed to shown internal details, plug on neutral connector 430 includes a generally U-shaped body 434 having somewhat parallel portions 438 which are spaced apart a distance d, which is generally less a thickness t of neutral bus 432. As a result of such arrangement, portions 438 tend to grip neutral bus 432, and thus create a robust electrical connection.

Although the disclosed concept has been described in connection with the modular circuit breaker 10 including exemplary operating mechanism 50 and trip device 80, it is to be appreciated that other arrangements of such internal components may be employed without varying from the scope of the present concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A primary assembly for use with a module assembly in a modular circuit breaker, the primary assembly comprising:

a primary housing having a first end structured to engage the module assembly;

a pair of separable contacts disposed in the primary housing;

a first terminal conductor disposed in or on the primary housing and structured to engage a line terminal, the first terminal conductor being electrically connected to one of the separable contacts;

a conductive tab electrically connected to another one of the separable contacts, the conductive tab extending outward from the first end of the primary housing;

an operating mechanism disposed in the primary housing for selectively opening and closing the separable contacts; and a trip mechanism disposed in the primary housing cooperative with the operating mechanism to trip open the separable contacts.

2. The primary assembly of claim 1, further comprising a control unit electrically connected to a solenoid, wherein the solenoid is structured to mechanically engage the operating mechanism upon receiving an electronic signal from the control unit, and wherein the control unit is electrically connected to a number of electrical connectors disposed at or about the first end of the primary housing.

3. The primary assembly of claim 2, further comprising a test module disposed on or in the primary housing and electrically connected to the control unit, the test module having a manual actuator which is positioned and structured to be manipulated by a user.

4. The primary assembly of claim 1, wherein the primary housing comprises:

a base member having a generally planar outer wall and a number of side walls which extend generally perpendicular to, and away from the outer wall;

a middle base member having a generally planar middle wall and a number of side walls which extend generally perpendicular to, and away from the middle wall;

a top cover including a generally planar outer wall; and a number of fasteners coupling the base member, middle base member and top cover together.

5. The primary assembly of claim 4, wherein the outer wall and the number of side walls of the base member and the middle wall of the middle base member define an operating mechanism cavity having the operating mechanism disposed therein; and wherein the middle wall and the number of side walls of the middle base member and the planar outer wall of the top cover define a PCB cavity in which a PCB assembly is disposed.

6. The primary assembly of claim 5 wherein the PCB assembly comprises:

a control unit electrically connected to a solenoid, wherein the solenoid is structured to mechanically engage the operating mechanism upon receiving an electronic signal from the control unit, and a test module disposed on or in the primary housing and electrically connected to the control unit, the test module having a manual actuator which is positioned and structured to be manipulated by a user, wherein the control unit is electrically connected to a number of electrical connectors disposed at or about the first end of the primary housing.

7. A modular circuit breaker comprising:

a primary assembly as recited in claim 1; and a module assembly coupled to the primary assembly, the module assembly comprising:

a module housing having a first end engaged with the first end of the primary housing of the primary assembly;

a second terminal conductor which is positioned within the module housing and electrically connected to the conductive tab and is structured to be electrically connected to a power conductor of a load;

a third terminal conductor which is positioned within the module housing and structured to be electrically connected to a neutral conductor of a load; and a fourth terminal conductor which is positioned and structured to be coupled to a neutral bus.

8. A module assembly for use with a primary assembly in a modular circuit breaker, the module assembly comprising:

a module housing having a first end structured to be engaged by the primary assembly;

a second terminal conductor which is positioned within the module housing and structured to be electrically connected to a power conductor of a load;

a third terminal conductor which is positioned within the module housing and structured to be electrically connected to a neutral conductor of a load; and a fourth terminal conductor which is positioned within the module housing and structured to be electrically connected to a neutral bus.

9. The module assembly of claim 8, wherein the module housing comprises:

a module base portion;

a module middle base portion; and a module top cover.

10. The module assembly of claim 9 wherein:

the module base member and the module middle base member define a second terminal cavity therebetween in which the second terminal conductor is disposed; and the module middle base member and the module top cover define a third terminal cavity therebetween in which the third terminal conductor is disposed.

11. The module assembly of claim 9, wherein the module base portion and the module middle portion are formed as a single continuous member.

12. The module assembly of claim 9, wherein the module middle base portion and the module top cover are formed as a single continuous member.

13. The module assembly of claim 9, wherein the module base portion, the module middle portion, and the module top cover are all formed as a single continuous member.

14. The module assembly of claim 9, further comprising a module PCB and a current transformer electrically connected to the module PCB, wherein the module PCB is electrically connected to at least one of a number of module electrical connectors disposed at or about the first end of the module housing, and wherein each of the third terminal conductor and the fourth terminal conductor are electrically connected to at least one of the number of module electrical connectors.

15. The module assembly of claim 9, wherein the fourth terminal conductor comprises a bolt on neutral connector.

16. The module assembly of claim 9, wherein the fourth terminal conductor comprises a plug on neutral connector.

17. A modular circuit breaker comprising:

a primary housing having a first end;

a pair of separable contacts disposed in the primary housing;

a first terminal conductor disposed in or on the primary housing and structured to engage a line terminal, the first terminal conductor being electrically connected to one of the separable contacts;

a conductive tab electrically connected to another one of the separable contacts, the conductive tab extending outward from the first end of the primary housing;

an operating mechanism disposed in the primary housing for selectively opening and closing the separable contacts; and a trip mechanism disposed in the primary housing cooperative with the operating mechanism to trip open the separable contacts; and a module assembly as recited in claim 8.

18. The modular circuit breaker of claim 17 wherein the module housing is rotatably coupled to the primary housing.

19. A method of assembling a modular circuit breaker comprising:

providing a primary assembly comprising:

a primary housing having a first end structured to engage the module assembly;

a pair of separable contacts disposed in the primary housing;

a first terminal conductor disposed in or on the primary housing and structured to engage a line terminal, the first terminal conductor being electrically connected to one of the separable contacts;

a conductive tab electrically connected to another one of the separable contacts, the conductive tab extending outward from the first end of the primary housing;

an operating mechanism disposed in the primary housing for selectively opening and closing the separable contacts; and a trip mechanism disposed in the primary housing cooperative with the operating mechanism to trip open the separable contacts; and coupling a module assembly as recited in claim 8 to the primary assembly.

* * * * *